US008910456B2

(12) United States Patent
Ortenzi et al.

(10) Patent No.: US 8,910,456 B2
(45) Date of Patent: Dec. 16, 2014

(54) APPARATUSES AND METHODS FOR STORING PHARMACEUTICAL PRODUCT

(75) Inventors: Vernon D. Ortenzi, Burlington, KY (US); Robert J. Ziemba, Cincinnati, OH (US); Brandon Craft, Reisterstown, MD (US)

(73) Assignee: Mallinckrodt, Hazelwood, MO (US)

( * ) Notice: Subject to any disclaimer, the term of this patent is extended or adjusted under 35 U.S.C. 154(b) by 968 days.

(21) Appl. No.: 13/014,896

(22) Filed: Jan. 27, 2011

(65) Prior Publication Data

US 2011/0225936 A1 Sep. 22, 2011

Related U.S. Application Data

(60) Provisional application No. 61/300,177, filed on Feb. 1, 2010.

(51) Int. Cl.

| | |
|---|---|
| ***B65B 51/10*** | (2006.01) |
| ***B65B 43/26*** | (2006.01) |
| ***B65D 50/04*** | (2006.01) |
| ***B65D 50/06*** | (2006.01) |

(52) U.S. Cl.

CPC ..... *B65D 50/04* (2013.01); *B65D 50/06* (2013.01); *B65D 2209/00* (2013.01)

USPC ..... 53/477; 53/412; 53/468

(58) Field of Classification Search

CPC ..... B65D 5/42; B65D 5/4291; B65D 5/4266; B65D 5/54; B65D 5/72; B65D 5/728; B65D 5/542; B65D 5/543

USPC ..... 53/492, 412, 477, 468; 206/531; 229/123.3, 210, 227, 102, 123.2

See application file for complete search history.

(56) References Cited

U.S. PATENT DOCUMENTS

| | | | | | |
|---|---|---|---|---|---|
| 2,086,534 | A | * | 7/1937 | Byrne | 220/811 |
| 2,492,864 | A | * | 12/1949 | Hermani | 206/540 |
| 4,113,098 | A | * | 9/1978 | Howard | 206/540 |
| 4,125,190 | A | * | 11/1978 | Davie et al. | 206/532 |
| 4,126,224 | A | * | 11/1978 | Laauwe et al. | 206/540 |
| 4,561,544 | A | * | 12/1985 | Reeve | 206/540 |
| 4,746,052 | A | * | 5/1988 | Schmissrauter | 229/102 |
| 4,793,549 | A | * | 12/1988 | Wald | 229/125.39 |
| 5,318,218 | A | * | 6/1994 | Mattson | 229/117.25 |

(Continued)

FOREIGN PATENT DOCUMENTS

WO 2009125267 10/2009

*Primary Examiner* — Hemant M Desai
*Assistant Examiner* — Gloria R Weeks
(74) *Attorney, Agent, or Firm* — James L. Johnson; March Fischman & Breyfogle LLP

(57) ABSTRACT

A container (100) for storing transdermal patches is disclosed. The container (100) includes a child-resistant mechanism (112) to reduce the likelihood of access to the transdermal patches (TP) by children. The child-resistant mechanism (112) may include first and second access components (116, 120) that may be disposed in a non-opposing manner and that may be in any appropriate form (e.g., buttons). Activation or engagement of the first and second access components (116, 120) in a particular manner allows the container (100) to assume an open configuration to access and/or load patches. In one arrangement, the first and second access components (116, 120) may be simultaneously engaged (e.g., depressed) to open the container (100). In another arrangement, the first and second access components (116, 120) may be engaged in series in a particular sequence to open the container (100).

18 Claims, 4 Drawing Sheets

(56) References Cited

U.S. PATENT DOCUMENTS

| | | | | |
|---|---|---|---|---|
| 5,678,690 | A * | 10/1997 | Belvederi et al. | 206/443 |
| 5,697,495 | A * | 12/1997 | Abrams et al. | 206/5.1 |
| 5,947,345 | A * | 9/1999 | Hofmann | 222/519 |
| 6,173,838 | B1 | 1/2001 | Brozell | |
| 6,334,532 | B1 * | 1/2002 | Tambo et al. | 206/268 |
| 6,401,926 | B1 * | 6/2002 | Lo | 206/531 |
| 6,558,501 | B1 * | 5/2003 | Franco | 156/277 |
| 6,726,006 | B1 * | 4/2004 | Funderburk et al. | 206/268 |
| 6,796,429 | B2 | 9/2004 | Cameron et al. | |
| 6,913,149 | B2 * | 7/2005 | Gelardi et al. | 206/538 |
| 6,974,028 | B2 * | 12/2005 | Ford et al. | 206/279 |
| 6,976,576 | B2 * | 12/2005 | Intini | 206/1.5 |
| 7,198,149 | B2 * | 4/2007 | Gelardi | 206/1.5 |
| 7,267,261 | B2 * | 9/2007 | Lo Duca | 229/102 |
| 7,275,642 | B2 * | 10/2007 | Yuhara | 206/581 |
| 7,591,372 | B2 * | 9/2009 | Gelardi et al. | 206/538 |
| 7,641,050 | B2 * | 1/2010 | Klatt et al. | 206/535 |
| 7,757,843 | B2 * | 7/2010 | Katsis | 206/1.5 |
| 7,757,846 | B2 * | 7/2010 | Blome et al. | 206/271 |
| 7,798,328 | B2 * | 9/2010 | Hession | 206/531 |
| 7,802,677 | B2 * | 9/2010 | Williams | 206/1.5 |
| 7,867,511 | B2 | 1/2011 | Anderson et al. | |
| 7,926,658 | B2 * | 4/2011 | Schein et al. | 206/468 |
| 8,011,512 | B2 * | 9/2011 | Brollier et al. | 206/531 |
| 8,359,816 | B2 * | 1/2013 | Guschke et al. | 53/411 |
| 8,458,994 | B2 * | 6/2013 | Guschke et al. | 53/415 |
| 8,499,936 | B2 * | 8/2013 | Albrecht et al. | 206/528 |
| 8,602,218 | B2 * | 12/2013 | Grosskopf | 206/531 |
| 8,701,974 | B2 * | 4/2014 | Davies et al. | 229/102 |
| 2003/0066270 | A1 * | 4/2003 | Lux et al. | 53/462 |
| 2003/0116614 | A1 * | 6/2003 | Block et al. | 229/146 |
| 2004/0188312 | A1 * | 9/2004 | Stepowany | 206/531 |
| 2005/0082194 | A1 * | 4/2005 | Fry et al. | 206/531 |
| 2006/0124708 | A1 * | 6/2006 | Lo Duca | 229/102 |
| 2007/0170196 | A1 | 7/2007 | Libohova et al. | |
| 2007/0235367 | A1 * | 10/2007 | Initini | 206/531 |
| 2009/0152134 | A1 | 6/2009 | Katsis | |
| 2009/0230177 | A1 * | 9/2009 | Robertson et al. | 229/123.3 |
| 2009/0266837 | A1 * | 10/2009 | Gelardi et al. | 221/154 |
| 2010/0264054 | A1 * | 10/2010 | Beecroft et al. | 206/531 |
| 2011/0000814 | A1 * | 1/2011 | Lee et al. | 206/528 |
| 2011/0000931 | A1 * | 1/2011 | Gelardi et al. | 221/1 |
| 2011/0067363 | A1 * | 3/2011 | Sprada et al. | 53/492 |
| 2011/0163155 | A1 * | 7/2011 | Kalin et al. | 229/122 |
| 2013/0264380 | A1 * | 10/2013 | Dolby et al. | 229/247 |

* cited by examiner

APPARATUSES AND METHODS FOR STORING PHARMACEUTICAL PRODUCT

CROSS-REFERENCE TO RELATED APPLICATIONS

This patent application claims priority to U.S. Provisional Patent Application Ser. No. 61/300,177, entitled "APPARATUSES AND METHODS FOR STORING PHARMACEUTICAL PRODUCT," filed on Feb. 1, 2010, and the entire disclosure of which is incorporated by reference in its entirety herein.

FIELD OF THE INVENTION

The present invention generally relates to the field of containers and packaging for pharmaceutical product and, more particularly, to containers and packaging for pharmaceutical product that provide resistance to tampering with and/or misuse by children or the like.

BACKGROUND

Transdermal (e.g., skin) patches are medicated adhesive patches placed on the skin to deliver a specific dose of medication through the skin (transdermally) and into the bloodstream. Transdermal patches are often supplied in child-resistant or sealed pouches composed of multilayer plastic films and metallic foils. These pouches (e.g., "primary packaging") are typically provided to the patient in a simple paperboard carton (e.g., "secondary packaging") which typically provides no additional security.

Unlike pills, transdermal patches may still have high residual doses of active pharmaceutical following use. A used transdermal patch can be very dangerous and even lead to death for children who have not been prescribed the particular transdermal patch. Several manners of disposing of new or used transdermal patches currently exist. For instance, transdermal patches may be flushed down the toilet. This practice has raised concerns about drug product entering the water supply. The recommended disposal method for at least some transdermal patches is to fold the sticky side of the transdermal patch in half, and to then place the same in the trash. However, this leaves used transdermal patches available for accidental access by a child or for deliberate misuse by an individual. Some states have enacted "take-back" programs, where users can request shipping materials that allow the users to ship used or unused pharmaceutical product (e.g., drugs) to a certified disposal company. These programs are costly and require several actions by the patient at multiple times.

SUMMARY

A first aspect of the present invention is directed to a pharmaceutical product container including a container body with first and second telescoping portions, pharmaceutical product (e.g., one or more transdermal patches; one or more transmucosal or buccal strips or films; one or more blister packs including pills, capsules, caplets, tablets, or the like, including an individual blister pack or multiple blister packs incorporated by a card, strip, or the like) within the container body, and first and second access components associated with the container body. These first and second access components are disposed in non-opposing relation to each other. The first access component is disposed on the first telescoping portion and the second access component is disposed on the second telescoping portion. Engagement (e.g., activation) of the first and second access components allows the container body to be moved from a closed configuration/position to an open configuration/position.

A second aspect of the present invention is directed to a pharmaceutical product container including a container body, pharmaceutical product within the container body, and first and second access components associated with the container body and disposed in non-opposing relation to each other. Engagement (e.g., activation) of the first and second access components allows the container body to be moved from a closed configuration/position to an open configuration/position. At least one of the first and second access components is removable from the container body. This thereafter disables any such access component (e.g., activation of any such access component should no longer allow the container body to be moved from the closed configuration to an open configuration).

A number of feature refinements and additional features are applicable to the first and second aspects of the present invention. These feature refinements and additional features may be used individually or in any combination. As such, each of the following features that will be discussed may be, but are not required to be, used with any other feature or combination of features of the first and second aspects.

The container body may be of any appropriate size, shape, configuration, and/or type. The container body may be in the form of a case, shell, or structure, and may have one or more internal compartments or chambers disposed inside the container body (e.g., when in a closed configuration). A given compartment may be appropriately sized to contain and/or hold a desired quantity of pharmaceutical product (e.g. to store one or more transdermal patches). Pharmaceutical product within primary packaging and pharmaceutical product without primary packaging may be disposed or inserted into the same compartment, or may be inserted into respective compartments in the container. That is, the container body may include multiple compartments (e.g., a first compartment for pharmaceutical product within primary packaging; a second compartment for pharmaceutical product that is not within primary packaging).

The container body may be of any appropriate form and may have any appropriate access member(s) to gain access to at least one internal compartment. In an embodiment, the container body may include first and second portions that telescope relative to each other in a first direction to configure the pharmaceutical product container in an open orientation or configuration, and in a second, opposite direction to configure the pharmaceutical product container in a closed orientation or configuration. Each internal compartment (and any pharmaceutical product inside) may be exposed in the open orientation or configuration and may be concealed in the closed orientation or configuration (e.g., locked within the pharmaceutical product container).

In another embodiment, the pharmaceutical product container may include any appropriate access member(s) to selectively provide access to pharmaceutical product or otherwise accommodate the insertion of pharmaceutical product into and/or the removal of pharmaceutical product from inside the pharmaceutical product container (e.g., from within one or more internal compartments). Moving the access member relative to the container body in first and second directions may respectively open and close the pharmaceutical product container. For instance, the access member may be in the form of a cover (e.g., lid). The access member may be rotatably attachable to the container body, pivotally interconnected to the container body, separately snapped onto the container body, or any combination thereof.

The pharmaceutical product container may be opened and/or at least one internal compartment may be accessed (e.g., to remove or load pharmaceutical product, including pharmaceutical product within individual primary packaging) by way of a child restraint mechanism in the form of first and second non-opposing access components (e.g., buttons, sensors, switches, levers) associated with the container body. Activation of these first and second access components may be characterized as changing the pharmaceutical product container from a locked configuration to an unlocked configuration. That is, a first force direction for activating the first access component and a second force direction for activating the second access component may be respectively associated with first and second vectors or straight lines that are non-collinear. The first and second access components may be associated with latches, linkages, springs, circuitry, logic, or the like (hereinafter collectively "componentry") in any appropriate manner to enable opening of the pharmaceutical product container, and may be disposed on and/or embedded within the container body. Furthermore, the componentry associated with the first access component need not necessarily directly interact or engage with the componentry of the second access component to allow the container to be opened. For instance, the respective componentry associated with the first and second access components may each independently engage or operate separate latches, both of which may need to be operated in any appropriate manner (e.g., simultaneously; in series) to allow the pharmaceutical product container to be opened. In other arrangements, the componentry of the first and second access components may interact with each other to allow opening of the pharmaceutical product container.

First and second access components may be used by the pharmaceutical product container to change the pharmaceutical product container from a locked configuration to an unlocked configuration. These first and second access components may be characterized as being disposed in non-opposing relation. For instance, each of the first and second access components may be movable along paths that are not collinear with one another and when activating the same. Moving the first and second access components along non-collinear paths may change the pharmaceutical product container from a locked configuration to an unlocked configuration.

In an embodiment, the container body may include first and second opposing sides and first and second opposing ends; the first access component may be disposed on one of the first and second opposing sides, while the second access component may be disposed on one of the first and second opposing ends. In an embodiment, the first and second access components may be respectively disposed on the first and second sides (e.g., being spaced different distances from the first end) or the first and second ends (e.g., being spaced different distances from the first side), but in non-opposing relation. In an embodiment and in the case of the container body being in the form of first and second telescoping portions, the first access component may be disposed on the first telescoping portion and the second access component may be disposed on the second telescoping portion.

Additional access components may be included with the pharmaceutical product container as part of a child restraint mechanism to increase a level of dexterity required to open the pharmaceutical product container. For instance, the pharmaceutical product container may include a third access component which may be disposed in non-opposing relation to one of the first and second access components, or which may be disposed in non-opposing relation to both of the first and second access components. In the latter regard, a user may be required to apply three different forces (e.g., utilizing three different fingers) along three non-collinear vectors. Other arrangements of access components are also envisioned and encompassed by the first and second aspects of the present invention. In any case, activation of the third access component may move along a path that is not collinear with a path that at least one of the first and second access components is moved when activated to change the pharmaceutical product container from a locked configuration to an unlocked configuration.

In one variation, at least one of the access components may be removed from the container body (e.g., may be of a "tear-away" design) to limit subsequent removal of pharmaceutical product from the pharmaceutical product container (e.g., such a removed access component thereafter being unable to be activated in a manner that allows the pharmaceutical product container to be changed from its closed configuration to an open configuration). That is, the likelihood of the pharmaceutical product container being opened by anyone (e.g., even those with average adult dexterity) may be reduced when an access component is removed from the pharmaceutical product container. For instance, removal of an access component may not only disable the removed access component in relation to the pharmaceutical product container, but may also disable the other access component(s) such that the pharmaceutical product container may be rendered difficult to open. As another example, removal of an access component may limit the ability of any latching mechanism previously interconnected with the now removed access component to allow the pharmaceutical product container to be opened.

The pharmaceutical product may be disposed or contained within any appropriate packaging. For instance, individual pharmaceutical products may be contained or disposed within any appropriate primary packaging such as sealed pouches, jackets, foil wrappers, blister cards, trays or packs, or the like. Additionally or alternatively, the pharmaceutical product and/or any associated primary packaging may be contained or disposed within any appropriate secondary packaging such as boxes, cartons, cases, or the like. For instance, the secondary packaging may be in the form of a box having a lid or flap that may be pivoted along a hinge or fold line to provide access, and may include at least two different compartments—one compartment for pharmaceutical product in a first state or condition (e.g., within primary packaging) and another compartment for pharmaceutical product in a second state or condition (e.g., not within primary packaging). The secondary packaging may be disposed within the container body of the first aspect (e.g., within an internal compartment). For instance, a given internal compartment may be sized to receive the secondary packaging (e.g., sized to receive the box) such that a box of pharmaceutical product may be inserted or slid into an internal compartment of the pharmaceutical product container.

Any of the above-described pharmaceutical product containers may be included as part of a kit along with pharmaceutical product being contained within primary packaging (e.g., a sealed pouch or blister card). For instance, a pharmacist or other personnel may supply a user with one or more pharmaceutical products each contained within a sealed pouch, in addition to a pharmaceutical product container for storing or containing the pharmaceutical product within the sealed pouches. As discussed above, the sealed pharmaceutical product pouches may come in secondary packaging (e.g., box, carton) which may be inserted into the pharmaceutical product container by the prescribing personnel and/or by the user.

Additionally, any of the pharmaceutical product containers may be used as part of a method of accessing pharmaceutical product contained within a given pharmaceutical product container, including engaging the first and second access components and thereafter opening the pharmaceutical product container. The first and second access components may be engaged in any appropriate manner. In one embodiment, the first and second access components may be simultaneously engaged to open the pharmaceutical product container. That is, a user may grasp the pharmaceutical product container and depress the first and second access components at the same time (e.g., by exerting non-collinear forces on the first and second access components). In another embodiment, the first and second access components must be sequentially engaged to open the pharmaceutical product container (e.g., in series). That is, the user may be required to activate or depress the access components in a particular sequence in order to open the pharmaceutical product container. Doing so may either cause the pharmaceutical product container to "pop" or spring open, or may unlock the pharmaceutical product container such that the user can then manually open the pharmaceutical product container (e.g., with another hand).

A third aspect of the present invention is directed to a method of using a pharmaceutical product container having pharmaceutical product therein. A first force is exerted on a first telescoping portion of the container along a first vector. A second force is exerted on a second telescoping portion of the pharmaceutical product container along a second vector that is not collinear with the first force vector. The pharmaceutical product container may be opened after the exertion of the first and second forces on the pharmaceutical product container in the noted manner.

A fourth aspect of the present invention is directed to a method of using a pharmaceutical product container having pharmaceutical product therein. A first force is exerted on the pharmaceutical product container along a first vector by activating a first access component on the pharmaceutical product container. A second force is exerted on the pharmaceutical product container along a second vector by activating a second access component on the pharmaceutical product container, and that is non-collinear with the first vector. The pharmaceutical product container may be opened after the activation of the first and second access components. The pharmaceutical product container is then closed, and at least one of the first and second access components is removed from the pharmaceutical product container.

A number of feature refinements and additional features are separately applicable to each of the third and fourth aspects of the present invention. These feature refinements and additional features may be used individually or in any combination. As such, each of the following features that will be discussed may be, but are not required to be, used with any other feature or combination of features of the third and fourth aspects of the present invention.

The exertion of the first and second forces on the pharmaceutical product container may include activating (e.g., engaging) first and second access components (e.g., buttons). As discussed previously, the first and second access components may be appropriately associated with latches, circuitry, or the like that, when activated and/or engaged in a certain manner, may function to open or allow opening of the pharmaceutical product container. The first and second access components may be disposed in non-opposing relation. The method may include removing and/or loading pharmaceutical product from/into the pharmaceutical product container after opening the same. The pharmaceutical product may be contained within primary packaging (e.g., sealed pouch, jacket, foil wrapper, blister card) and/or secondary packaging (e.g., box, carton).

The exertion of the first and second forces on the pharmaceutical product container may occur in any appropriate manner. In one embodiment, the first and second forces are simultaneously exerted on the pharmaceutical product container to open the same. For instance, a user may grasp the pharmaceutical product container and depress the first and second access components at the same time. In another embodiment, the first and second forces must be sequentially exerted on the pharmaceutical product container to open the same (e.g., in series). That is, the user may be required to activate or depress the access components in a particular sequence in order to open the pharmaceutical product container. Doing so may either cause the pharmaceutical product container to "pop" or spring open, or may unlock the pharmaceutical product container such that the user can then manually open the pharmaceutical product container (e.g., with another hand).

One or more additional forces may be required to be exerted on the pharmaceutical product container to open the same. For instance, opening the pharmaceutical product container may require that a third force be exerted on the pharmaceutical product container. This third force may be along a third vector. The third vector associated with this third force may be non-collinear to one of the first and second vectors, or may be non-collinear to both of the first and second vectors.

A fifth aspect of the present invention is a method for managing use of pharmaceutical product. A pharmaceutical product container includes first and second non-opposing access components, is disposable in each of open and closed configurations, and is locked when in its closed configuration. The method includes activating each of the first and second access components, and unlocking the pharmaceutical product using each of these activations. At least the first access component may be disabled. Disabling the first access component thereafter eliminates the ability of the first access component to be used to unlock the pharmaceutical product container.

A number of feature refinements and additional features are applicable to the fifth aspect of the present invention. These feature refinements and additional features may be used individually or in any combination. As such, each of the following features that will be discussed may be, but are not required to be, used with any other feature or combination of features of the fifth aspect of the present invention.

Unlocking the pharmaceutical product container when in its closed configuration requires activation of at least the first and second access components. Activation of the first access component may include exerting a first force on the first access component, where this first force is along or is defined by a first vector. Activation of the second access component may include exerting a second force on the second access component, where this second force is along or is defined by a second vector. These first and second vectors may be other than collinear (e.g., there may be a non-collinear relationship between the first and second vectors).

The pharmaceutical product container may include a third access component. Activation of this third access component may also be required (i.e., in addition to activation of the first and second access components) to unlock the pharmaceutical product container when in its closed configuration. Activation of the third access component may include exerting a third force on the third access component, where this third force is along or is defined by third vector. In one embodiment, this third vector is non-collinear relative to one of the above-noted first and second vectors (associated with the exertion of forces on the first and second access components, respectively). In one embodiment, this third vector is non-collinear relative to each of the above-noted first and second vectors (again, associated with the exertion of forces on the first and second access components, respectively).

Pharmaceutical product of any appropriate type and in any appropriate form may be stored in the pharmaceutical product container. This pharmaceutical product may be in the form of at least one transdermal patch, at least one transmucosal strip or film, at least one buccal strip or film, at least one pharmaceutical product blister pack, or any combination thereof.

Unlocking the pharmaceutical product container by activation of at least the first and second access components may be used to remove pharmaceutical product from the pharmaceutical product container, to load pharmaceutical product into the pharmaceutical product container, or both. In each instance, the pharmaceutical product container may be disposed or moved into an open configuration (e.g., automatically where the pharmaceutical product container "springs open" in response to activation of at least the first and second access components; manually by a user and after activation of at least the first and second access components). At least some of the pharmaceutical product that is stored within the pharmaceutical product container may be contained within primary packaging (e.g., a sealed pouch or the like). At least some of the pharmaceutical product that is stored within the pharmaceutical product container may be contained within secondary packaging (e.g., a carton or box), where pharmaceutical product within primary packaging may be collectively disposed within this secondary packaging. The secondary packaging may contain pharmaceutical product in a first condition (e.g., within primary packaging), may contain pharmaceutical product in a second condition (e.g., previously removed from associated primary packaging), or both.

Pharmaceutical product stored within the pharmaceutical product container may be characterized as being in a sealed condition (e.g., within a sealed pouch or the like; within a blister pack) at least when originally loaded into the pharmaceutical product container. At least some of the pharmaceutical product may be in a sealed condition when stored in the pharmaceutical product container (e.g., within primary packaging), at least some of the pharmaceutical product may be in an unsealed condition when stored in the pharmaceutical product container (e.g., having been removed from primary packaging), or a combination thereof.

At least one simultaneous activation of the first and second access components may be required to unlock the pharmaceutical product container, at least one sequential activation of the first and second access components may require to unlock the container (e.g., activation of the first access component, followed at some point in time by an activation of the second access component, or vice versa; where the first and second access components are activated in series), or a combination thereof. Activation of the first access component may entail moving the first access component along a first path (e.g., depressing the first access component in the form of a button), while activation of the second access component may entail moving the second access component along a second path (e.g., depressing the second access component in the form of a button), where the first and second paths are not disposed along a common line (e.g., the first and second paths are other than collinear).

The first access component may be disabled by removing the same from the pharmaceutical product container (e.g., utilizing a tear away design). Another option for disabling the first access component entails heating the pharmaceutical product container to a temperature that should eliminate the ability of the first access component to be used to unlock the pharmaceutical product container. That is, after being heated to an appropriate temperature, any subsequent activation of the first access component should not result in any unlocking of the pharmaceutical product container. Exposure to such a temperature could damage the first access component, could damage one or more components in a locking mechanism that is changed to an unlocked state or condition by activation of the first access component, or both. Preferably, the temperature that provides such a disabling effect is less than a melting temperature of a container body of the pharmaceutical product container. More than one access component of the pharmaceutical product container could incorporate one or more features for disabling the same in the noted manner—such that any subsequent activation should not unlock the pharmaceutical product container.

A number of feature refinements and additional features are separately applicable to each of above-noted first, second, third, fourth, and fifth aspects of the present invention as well. These feature refinements and additional features may be used individually or in any combination in relation to each of the first, second, third, fourth, and fifth aspects.

A "pharmaceutical product" as used herein may generally define any material or substance used in the course of a medical treatment, medical diagnosis, therapy, or the provision of any other appropriate medical care. A given material need not contain an active drug compound or ingredient to be considered a "pharmaceutical product" for purposes of the present invention.

Pharmaceutical product within a container (e.g., within a container body) in accordance with the present invention may be in any appropriate form, in any appropriate dose, and of any appropriate type. A pharmaceutical product encompasses both a single-dose configuration (e.g., a single pill) and a multiple dose configuration (e.g., a plurality of pills). Pharmaceutical product may be in any appropriate form such as (but not limited to) pills, tablets, chewables, capsules, powders, fluids (e.g., liquids, suspensions, emulsions), patches (e.g., transdermal patches), films (e.g., transmucosal or buccal), strips (e.g., transmucosal or buccal), blister packs having pills, capsules, caplets, tablets, etc. therein (including individual blister packs as well as where multiple blister packs are incorporated by a card, strip, or the like), or the like. Further, a "pharmaceutical product" may refer to or include any "drug" as defined in Title 21 of the United States Code, Section 321(g)(1).

All pharmaceutical product within the container (e.g., within a container body) in accordance with the present invention may be of at least substantially common dose. Alternatively, some pharmaceutical product could be of one dose (e.g., a prescribed dose), while some pharmaceutical product could be of a different dose (e.g., in the form of a transdermal patch that has been used by a patient, such that at least part of its original dosage has already been transdermally administered to a patient). All pharmaceutical product within a container could be in a common first condition. For instance and in the case of transdermal patches, all transdermal patches within a container could be contained within individual primary packaging (e.g., within a sealed pouch, jacket, foil wrapping, or the like), or all transdermal patches within a container could be in an exposed state (e.g., where the individual transdermal patches have been removed from their associated primary packaging before being disposed within the container). Some pharmaceutical product within a container could be in a common first condition, such as contained within individual primary packaging (e.g., within a sealed pouch, jacket, foil wrapping, or the like), while some pharmaceutical product within a container could be in a common second condition (e.g., in an exposed state or where the individual transdermal patches have been removed from their associated primary packaging before being disposed within the container). In the case of blister packs or strips, some of the pharmaceutical product (e.g., pills, tablets) may have been removed from the individual receptacles of the blister packs, while other pharmaceutical product may remain sealed within the individual receptacles.

Any transdermal patches utilized with the present invention may include any appropriate pharmaceutical product (e.g., one or more "drugs" as discussed above). Examples of appropriate pharmaceutical products that may be included in such transdermal patches include (but are not limited to): U.S. Drug Enforcement Administration (DEA) scheduled (e.g., Schedule II) drugs such as fentanyl, lidocaine, tetracaine, prilocaine, thebaine, buprenorphine, sufentanil, alfentanil, codeine, dihydrocodeine, hydrocodone, hydromorphone, levorphanol, methadone, morphine, nalbuphine, noscapine, opium, oxycodone, and propoxyphene; non-steroidal anti-inflammatory drugs (NSAIDs) such as ketoprofen, diclofenac, flurbiprofen, and ibuprofen; steroids such as testosterone and estradiol; psychoactive drugs such as buspirone; vitamins such as vitamin B12; vasodilators such as nitroglycerin; vaccines; antiemetics; capsaicin; and nicotine. Further, any transdermal patches utilized with the present invention can function to provide drug delivery in any appropriate manner. For instance, such transdermal patches may include those functioning via a passive delivery mechanism (e.g., pharmaceutical product located within the adhesive of the patch, within a reservoir of the patch, within a semisolid matrix (e.g., a gel)) or via an active delivery mechanism (e.g., iontophoresis, sonophoresis, electroporation, microneedles, abrasion, needle-less injection, suction, stretching, magnetophoresis, radio frequency, lasers, photomechanical waves, temperature (e.g., heat-activation)).

Any of the embodiments, arrangements, or the like discussed herein may be used (either alone or in combination with other embodiments, arrangement, or the like) with any of the disclosed aspects. Any feature disclosed herein that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a container includes "a compartment" alone does not mean that the container includes only a single compartment). Moreover, any failure to use phrases such as "at least one" also does not limit the corresponding feature to the singular (e.g., indicating that a container includes "a compartment" alone does not mean that the container includes only a single compartment). Use of the phrase "at least generally," "at least partially," or the like in relation to a particular feature encompasses the corresponding characteristic and insubstantial variations thereof. Finally, a reference of a feature in conjunction with the phrase "in one embodiment" or the like does not limit the use of the feature to a single embodiment.

DETAILED DESCRIPTION

Figures 1A, 1B:
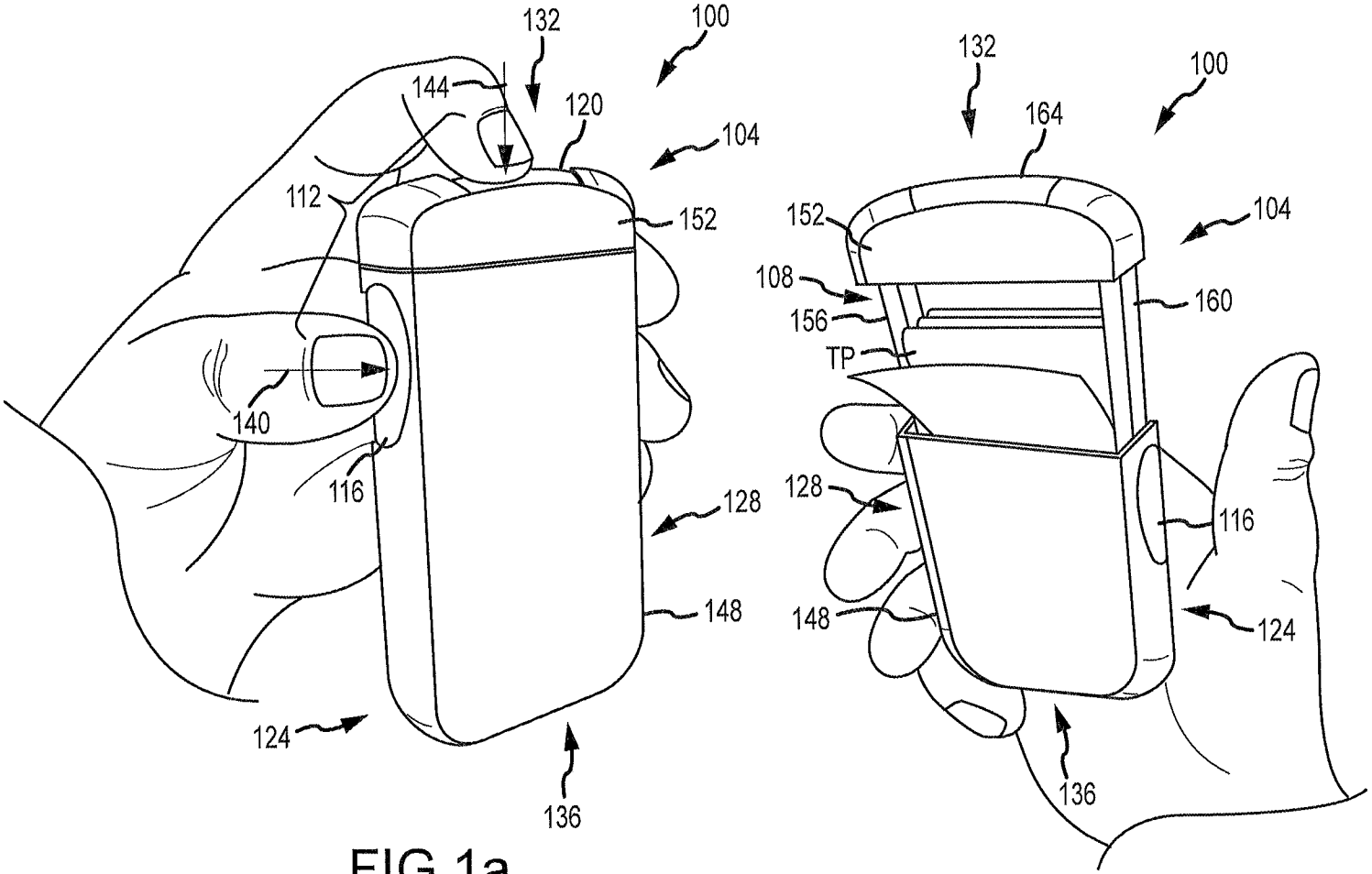
FIG. 1*a* is a rear perspective view of one embodiment of a pharmaceutical product container in a closed configuration.
FIG. 1*b* is a front perspective view of the pharmaceutical product container of FIG. 1*a* in an open configuration.
Figure 1D:
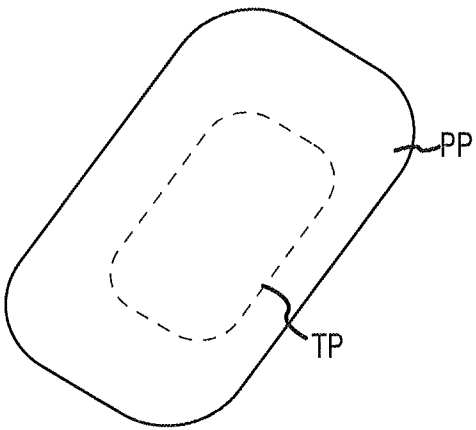
FIG. 1*d* is a schematic of a pharmaceutical product within primary packaging.
Figure 1C:
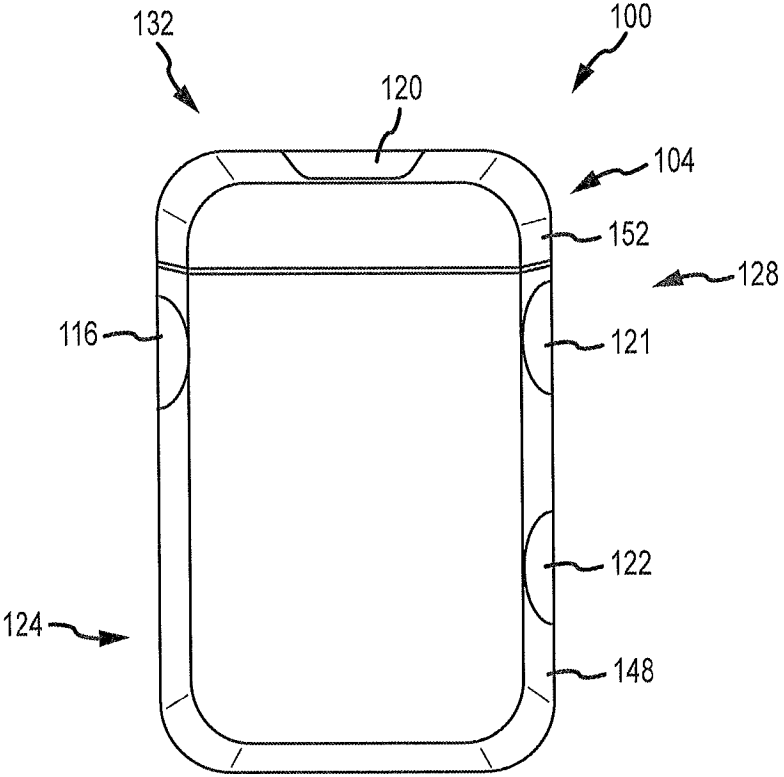
FIG. 1*c* is a rear plan view of the pharmaceutical product container of FIG. 1 in a closed configuration.

FIGS. 1*a*, 1*b*, and 1*c* present one embodiment of a pharmaceutical product container 100 (e.g., case, box), in closed and open configurations, respectively. Hereafter, the pharmaceutical product container 100 may simply be referred to as "container 100." The container 100 may be used in conjunction with any appropriate pharmaceutical product and as described herein. As such, one or more transdermal patches as described herein may be stored in the container 100. One or more transmucosal or buccal strips or films may also be stored in the container 100. One or more blister packs or cards (having pharmaceutical product within predefined receptacles) may be stored in the container 100 as well.

The container 100 may be used to store one or more individual pharmaceutical products or pharmaceutical product doses. All pharmaceutical product within the container 100 may be of at least substantially common dose. Alternatively, some pharmaceutical product could be of one dose (e.g., a prescribed dose), while some pharmaceutical product could be of a different dose (e.g., in the form of a transdermal patch that has been used by a patient, such that at least part of its original dosage has already been transdermally administered to the patient). All pharmaceutical product within the container 100 could be in a common first condition. For instance and in the case of transdermal patches, all transdermal patches within the container 100 could be contained within individual primary packaging (e.g., within a sealed pouch, jacket, foil wrapping, or the like), or all transdermal patches within the container 100 could be in an exposed state (e.g., where the individual transdermal patches have been removed from their associated primary packaging before being disposed within the container 100). Some pharmaceutical product within the container 100 could be in a common first condition, such as contained within individual primary packaging (e.g., within a sealed pouch, jacket, foil wrapping, or the like), while some pharmaceutical product within the container 100 could be in a common second condition (e.g., in an exposed state or where the individual transdermal patches have been removed from their associated primary packaging before being disposed within the container 100). In the case of blister packs or strips, some of the pharmaceutical product (e.g., pills, tablets) may have been removed from the individual receptacles of the blister packs, while other pharmaceutical product may remain sealed within the individual receptacles.

The pharmaceutical product container 100 may be used to store pharmaceutical product, at least a portion of which may be within primary packaging. FIG. 1*d* schematically illustrates a pharmaceutical product in the form of a transdermal patch TP within primary packaging PP in the form of a sealed pouch, jacket, foiled structure, or the like. Other types of pharmaceutical product could be contained within this same type of primary packaging PP, such as one or more transmucosal or buccal strips or films, or in other types of primary packaging. Although the container 100 may hereafter be described in relation to the use of the same with transdermal patches TP, again, it is not limited to this particular application. Instead, the container 100 may be used for storing numerous other types of pharmaceutical product (e.g., transmucosal strips or film, buccal strips or film, blister cards or packs containing pills, tablets, etc.).

Referring back to FIGS. 1*a*-1*c*, the container 100 may generally include a container body 104 of any appropriate design and construction. The container body 104 may include one or more compartments 108 (e.g., internal compartments, chambers) for holding or storing one or more transdermal patches TP. Access to the compartment 108 may be provided via one or more child-resistant mechanisms 112. For convenience, components and features introduced as "one or more" of such components and features (e.g., one or more compartments 108) may be discussed herein as "the" component or feature (e.g., the compartment 108), although it should be appreciated that this terminology also encompasses use of a plurality of the component and feature (e.g., a plurality of compartments 108). As will be discussed more fully below and upon engagement of the child-resistant mechanism 112, the compartment 108 and/or any transdermal patch TP contained therewithin may become accessible.

The child resistant mechanism 112 may include first and second access components 116, 120 (e.g., buttons, sensors, levers) disposed in a non-opposing relationship that may be engaged (e.g., depressed) in one of a number of various manners (discussed more fully below) to gain access to the compartment 108 and/or any transdermal patch TP contained within the compartment 108. Stated otherwise, the directions that forces may be applied to engage the first and second access components 116, 120 may be disposed in non-collinear relation, or in other words may be represented by vectors that are not collinear (e.g., first and second non-collinear vectors). In this regard, a greater level of dexterity may be required to engage the first and second access components 116, 120, which may reduce the potential for children gaining access to the compartment 108 and any transdermal patches TP thereinside.

The first and second access components 116, 120 may be characterized as being movable along first and second paths, respectively, that are not collinear with one another (e.g., by depressing the same). The first and second access components 116, 120 may be moved along their respective path when being activated. Activating the first and second access components 116, 120 may be characterized as changing the container 100 from a locked configuration to an unlocked configuration, as at least allowing the container 100 to be moved from a closed configuration/position to an open configuration/position, or both.

The container body 104 may include first and second opposing sides 124, 128, along with first and second opposing ends 132, 136. The first access component 116 may be disposed on one of the first and second sides 124, 128 (as shown, on the first side 124) and the second access component 120 may be disposed on one of the first and second ends 132, 136 (as shown, on the first end 132). Here, a first force direction or vector 140 to engage the first access component 116 (e.g., the vector of the force that activates the first access component 116) may be in a direction from the first side 124 towards the second side 128 of the container body 104, and a second force direction or vector 144 of the second access component 120 (e.g., the vector of the force that activates the second access component 120) may be in a direction from the first end 132 towards the second end 136. As can be seen, the first and second vectors 140, 144 are not collinear, which may provide an obstacle to opening the container 100 as a person (e.g., child) may not be able to merely grasp and squeeze the container 100 with the palm and finger(s) moving directly towards each other (e.g., along collinear vectors) to open the container 100. It should be appreciated that the "first" and "second" access components 116, 120 are merely arbitrary labels and should not imply that the first access component 116 and second access component 120 could not respectively be disposed on other portions of the container body 104 and/or activated in any appropriate manner/sequence. What is important is that the first and second access components 116, 120 are disposed in a non-opposing manner.

One or more additional access components may also be included as part of the child resistant mechanism 112 in any appropriate location to provide extra levels of child resistance. For instance and with reference now to FIG. 1*c*, the container 100 may include at least one of a third access component 121 and a fourth access component 122 (not visible in FIGS. 1*a* and 1*b*). As illustrated, the third access component 121 may be disposed opposite from the first access component 116, but in non-opposing relation to the second access component 120. The fourth access component 122 may be disposed in non-opposing relation to each of the first, second and third access components 116, 120, 121. In some arrangements, the container 100 may only include the illustrated first and fourth access components 116, 122 and which are disposed in non-opposing relation to each other. In other arrangements, the container 100 may only include the illustrated first, second, and fourth access components 116, 120, 122. In this regard, access to the interior of the container 100 may require the engagement of each of the first, second, and fourth access components 116, 120, 122 by three different fingers (e.g., thumb, index finger, ring finger), the engagement force direction of each being non-collinear or non-opposing with the engagement force direction of the others. Other arrangements of access components are also envisioned. Generally, two more or more access components may need to be engaged to gain access to the interior of the container 100, and at least two of these access components are disposed in non-collinear relation. Multiple forces may be required to be exerted on the container 100 to open the same, and the associated vectors of at least two of these forces are not collinear. Each such access component may be characterized as being movable along a path to activate the same, and at least two access components must be moved along non-collinear paths to change the container 100 from a locked configuration to an unlocked configuration and/or to at least allow the container 100 to be moved from a closed configuration/position to an open configuration/position.

As previously mentioned, the access components (at least two non-opposing access components) may be engaged (or first and second forces may be exerted against the container 100) in a plurality of different manners to gain access to an interior of the container 100 and any transdermal patches TP thereinside. Any appropriate activation pattern for at least two access components may be utilized (e.g., one or more simultaneous activations of one or more access component, one or more sequential activations of two or more access components, or any combination thereof). In one arrangement, the access components may be engaged simultaneously to gain access to the interior of the container 100. In another arrangement, the access components may be engaged in a particular sequence (e.g., in series) to open the container 100. For instance, the first access component 116 may be required to be depressed first, and the second access component 120 may be required to be depressed second. More complicated sequences or patterns are also envisioned, such as depressing the first access component 116 a particular number of times followed by depressing the second access component 120 a different particular number of times. It should be appreciated that the container 100 as a whole may be in almost any particular orientation while still allowing for the child resistant mechanism 112 to be activated. That is, it may not be necessary to orient the container 100 relative to some reference position (e.g., relative to the ground) before being able to appropriately engage or activate the child resistant mechanism 112.

In other embodiments, the container 100 may include one or more features to facilitate disposal of the container 100 and any pharmaceutical product thereinside. In one arrangement, one or more of the access components may be of a "tear-away" design or otherwise selectively removable to thereafter substantially reduce the potential of any subsequent reopening of the container 100. For instance, the access components may include any appropriate feature(s) (e.g., pulling tab, screwdriver slot) to facilitate removal of the access components. Removal of an access component may, for example, disengage at least part of the componentry necessary to allow opening of the container 100, or otherwise disable the removed access component and/or at least one other access component. In any event, and once the container 100 is closed for the final time, the user could pull off one or more of the access components to limit any subsequent reopening of the container 100. In another arrangement, one or more of the access components and/or features associated with the access components (e.g., componentry, levers and latches operated by the access components to open the container 100) may be constructed of a heat-activated or meltable material. In this regard, and upon determining that the container 100 and/or pharmaceutical product within the container 100 is ready for disposal or has otherwise been used for the final time, a user may heat the container 100 (e.g., via a microwave oven) to at least the melting temperature of the access components (but less than the melting temperature of the container body 104) to melt and otherwise render the access components unusable. After the user has allowed the container 100 to cool for a predetermined period of time, the container 100 may be appropriately disposed of. Other arrangements are also envisioned.

As seen, the container body 104 may include first and second telescoping portions 148, 152. More specifically, the second telescoping portion 152 may telescope, translate, and/or slide into and out of the first telescoping portion 148 as the container 100 transitions between the closed configuration of FIG. 1*a* and the open configuration of FIG. 1*b* to selectively conceal and expose the compartment 108. In this regard, the second telescoping portion 152 may be in the form of an "access member" that selectively provides access to the compartment 108. The first telescoping portion 148 may include one access component (e.g., the first access component 116) and the second telescoping portion 152 may include another access component (e.g., the second access component 120). The first and second telescoping portions 148, 152 may collectively define the compartment 108 for storing transdermal patches TP. For instance, the second telescoping portion 152 may include first and second rails 156, 160 interconnected by a cross-piece 164 that may collectively function to at least partially contain transdermal patches TP contained in the compartment 108. The first telescoping portion 148 may be in the form of a housing (not labeled) with a chamber (not labeled) sized to receive the first and second rails 156, 160. The chamber of the housing, together with the space within the first rail 156, second rail 160, and the cross-piece 164, may collectively form the compartment 108. Although not shown, additional compartments may be defined as part of (e.g., within) or separate from the compartment 108 (e.g., for storing new and/or used transdermal patches TP).

Figure 2A:
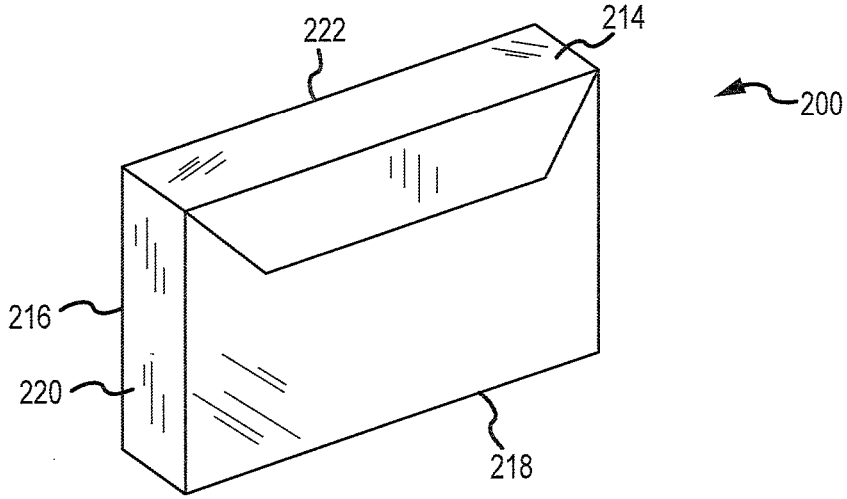
FIG. 2*a* is a perspective view of one embodiment of a pharmaceutical product box in a closed configuration.
Figure 2B:
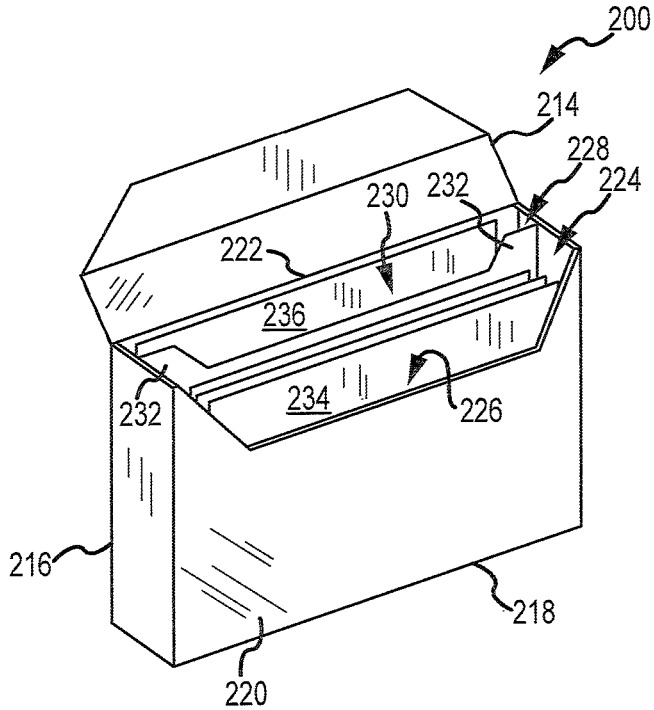
FIG. 2*b* is a perspective view of the pharmaceutical product box of FIG. 2*a* in an open configuration.

With reference now to FIGS. 2*a* and 2*b*, a carton, packaging or box 200 is shown for holding a number of transdermal patches. The box 200 may include a body 216 and a lid 214. The lid 214 is movable relative to the container body 216 by a hinge 222 of any appropriate type (e.g., a fold line between the lid 214 and container body 216). Generally, the lid 214 may be disposed in the closed position of FIG. 2*a*, and may be moved relative to the container body 216 to the open position shown in FIG. 2*b* to provide access to the interior of the box 200. Other types of lids could be used with the box 200, for instance lids that are totally removable from the container body 216 (e.g., via a detachable interconnection (e.g., snap lock, threads) such that the lid could be attached, removed, and reattached to the container body 216 without damaging either the lid and/or container body 216).

The container body 216 includes a base 218 and a container body sidewall 220. The base 218 is disposed opposite of the above-noted lid 214. Disposing the base 218 on an appropriate supporting surface in turn disposes the box 200 in an upright position. The lid 214 and container body 216 may be of any appropriate size, shape, and/or configuration. In one embodiment, the lid 214 and container body 216 are integrally formed (e.g., a unitary structure without any joint(s) between the lid 214 and container body 216). The lid 214 and container body 216 each may be formed from any appropriate material or combination of materials. In one embodiment, the lid 214 and container 216 are each formed from cardboard.

The box 200 may include a plurality of separate storage areas. FIG. 2*b* shows the lid 214 in an open position that exposes a first compartment 224 and a second compartment 228. A divider 232 separates the first compartment 224 from the second compartment 228, for instance by extending between opposing portions of the container body sidewall 220. As such, the first compartment 224 is defined by a first portion of the container body sidewall 220 and the divider 232, while the second compartment 228 is defined by a second portion of the container body sidewall 220 and the divider 232.

Access to each of the first compartment 224 and the second compartment 228 is controlled by the lid 214 of the box 200. Disposing the lid 214 in its open position (e.g., FIG. 2*b*) exposes a first opening 226 that provides access to an entirety of the first compartment 224. Disposing the lid 214 in its open position (e.g., FIG. 2*b*) also simultaneously exposes a second opening 230 that provides access to an entirety of the second compartment 228.

One or more first transdermal patches 234 may be stored in the first compartment 224, while one or more second transdermal patches 236 may be simultaneously stored in the second compartment 228. The divider 232 at least somewhat isolates (e.g., physically) the first compartment 224 from the second compartment 228. Therefore, the first transdermal patches 234 should in turn be physically isolated from the second transdermal patches 236. Typically, the first transdermal patches 234 will be contained within appropriate primary packaging (e.g., within a sealed pouch, jacket, or foil wrap). The first compartment 224 may be sized to accommodate any appropriate number of first transdermal patches 234. Similarly, the second compartment 228 may be sized to accommodate any appropriate number of second transdermal patches 236.

FIG. 1*d* again shows a transdermal patch TP within primary packaging PP. The transdermal patch TP may be of any appropriate shape and of any appropriate configuration. The transdermal patch TP may include any appropriate pharmaceutical product. Examples of appropriate pharmaceutical products that may be included in such transdermal patches include (but are not limited to): U.S. Drug Enforcement Administration (DEA) scheduled (e.g., Schedule II) drugs such as fentanyl, lidocaine, tetracaine, prilocaine, thebaine, buprenorphine, sufentanil, alfentanil, codeine, dihydrocodeine, hydrocodone, hydromorphone, levorphanol, methadone, morphine, nalbuphine, noscapine, opium, oxycodone, and propoxyphene; non-steroidal anti-inflammatory drugs (NSAIDs) such as ketoprofen, diclofenac, flurbiprofen, and ibuprofen; steroids such as testosterone and estradiol; psychoactive drugs such as buspirone; vitamins such as vitamin B12; vasodilators such as nitroglycerin; vaccines; antiemetics; capsaicin; and nicotine. Further, the transdermal patch TP can function to provide drug delivery in any appropriate manner. For instance, the transdermal patch TP may include those functioning via a passive delivery mechanism (e.g., pharmaceutical product located within the adhesive of the patch, within a reservoir of the patch, within a semisolid matrix (e.g., a gel)) or via an active delivery mechanism (e.g., iontophoresis, sonophoresis, electroporation, microneedles, abrasion, needle-less injection, suction, stretching, magnetophoresis, radio frequency, lasers, photomechanical waves, temperature (e.g., heat-activation)).

The first transdermal patches 234 may differ from the second transdermal patches 236 in one or more respects. The first transdermal patches 234 may be characterized as being new or unused (e.g., not yet having been mounted on or adhered to a patient), while the second transdermal patches 236 may be characterized as having been used by a patient (e.g., having been mounted on or adhered to a patient). The first transdermal patches 234 may be individually contained within appropriate primary packaging (e.g., within a sealed pouch, jacket, foil wrapping, or the like), while the second transdermal patches 236 may be in an exposed state or where the individual second transdermal patches 236 have been removed from their associated primary packaging before being disposed within the second compartment 228. Each of the "exposed" second transdermal patches 236 may either have been used by a patient (e.g., having been mounted on or adhered to a patient such that pharmaceutical product was delivered transdermally to the patient) or not (e.g., the second compartment 228 may contain one or more transdermal patches that were removed from their associated primary packaging and disposed in the second compartment 228 before being used by a patient). The first transdermal patches 234 may include a first amount of pharmaceutical product (e.g., a prescribed dose), while the second transdermal patches 236 may include a second amount of pharmaceutical product (e.g., something less than that prescribed dose, for instance based upon the transdermal patch having been mounted on or adhered to a patient for a period of time such that at least part of its pharmaceutical product was delivered transdermally to the patient), where the first and second amounts are different.

Turning back to FIG. 1*b*, the compartment 108 of the container 100 may be sized to receive secondary packaging such as a box or carton (e.g., the box 200 of FIGS. 2*a*-2*b*) that includes a plurality of transdermal patches TP, at least some of which may be contained within any appropriate primary packaging (e.g., a sealed pouch or foiled structure, not labeled). Any appropriate secondary packaging (e.g., that contains one or more first transdermal patches 234, that contains one or more second transdermal patches 236, or both) may be positioned within the container 100.

It should be appreciated herein that use of "TP" could signify a transdermal patch itself or a transdermal patch contained within a sealed pouch or the like. For instance, upon engaging the child-resistant mechanism 112 so as to gain access to and/or expose the compartment 108, the box 200 may be inserted into the compartment 108. It should be appreciated that the box 200 may itself be opened (to access the transdermal patches contained therein) either before or after being inserted into the compartment 108. Thereafter, a transdermal patch TP could be removed and/or the container 100 could be closed (e.g., via sliding the first and second telescoping portions 148, 152 towards each other) until another transdermal patch TP is required/desired, at which point the container 100 may be opened again. Transdermal patches TP, that have been removed from their primary packaging, may be placed back into the box 200 at any appropriate location (e.g., in the second compartment 228), into the compartment 108 but outside of the box 200, and/or in another compartment within the container 100 (e.g., a compartment reserved for transdermal patches TP that are not within any primary packaging). Transdermal patches TP within primary packaging could be removed from the box 200 and placed directly into the compartment 108 (e.g., while within a sealed pouch or other primary packaging).

In one arrangement, sealed pouches containing transdermal patches TP may be of an "easy-open" configuration (e.g., non-child resistant). In this regard, persons with reduced dexterity (e.g., those with osteoarthritis) may be able to open the container 100 via the child-resistant mechanism 112 and then easily open the sealed pouches containing the transdermal patches TP. The potential that children may access the transdermal patches TP may be reduced though due to, for instance, the size of the container 100 (e.g., the container 100 may have a (large) size that inhibits handling by children) and/or the orientation or relative positioning of the above-noted access components and the forces that must be exerted thereon to open the container 100 (e.g., where the vectors of at least two activation forces required to open the container 100 are oriented other than in linear relation or along a common line).

Any appropriate mechanical and/or electromechanical devices may be incorporated into the container 100 to enable the opening and closing of the container 100, the locking or latching of the container 100 in the closed configuration, or the like. For instance, each of the access components may be associated with any appropriate latch or latches that may function to limit movement of the container 100 into the open configuration. The access components may be mechanically and/or electrically interconnected or linked to collectively allow opening of the container 100. Any appropriate biasing mechanism (e.g., spring) may be incorporated between the first and second telescoping mechanisms 148, 152 that may cause the container 100 to "pop" or eject into the open configuration. Additionally, the container 100 and any other components of the container 100 may be constructed of any appropriate materials such as one or more appropriate types of plastic (e.g., high density polyethylene (HDPE), styrene-acrylonitrile (SAN)) and/or any polymers or copolymers suitable for use in injection molding or extrusion processing.

The container 100 may be included as part of a kit with transdermal patches TP and/or a box or carton (e.g., the box 200 of FIGS. 2*a*-2*b*) of transdermal patches TP and/or other types of pharmaceutical product (e.g., blister cards). For instance, upon receipt of the kit, a user may insert the box 200 of transdermal patches TP into the container 100 and/or remove sealed pouches containing the transdermal patches TP from the box 200 and insert or otherwise place the sealed pouches into the container 100. It should also be appreciated that the container 100 may be disposable. That is, upon completing a final dose or utilizing a transdermal patch TP for the final time, a user could appropriately close the container 100 "for the final time" (e.g., removing a tear-away button; heating the container 100 to a temperature that thereafter disables the ability of one or more access components to unlock the container 100), and then dispose of the container 100. In one arrangement, the user could place used transdermal patches back into the container 100 during the entire prescription period such that upon disposal, all transdermal patches are contained within a substantially non-accessible container. It should be appreciated that the transdermal patches TP may be disposed within the box 200, which may be disposed within the container 100, all of which may be disposed of in any appropriate trash receptacle.

The container 100 may also be re-used by a patient any appropriate number of times. For instance, a new prescription of transdermal patches TP may be stored in the container 100 in any appropriate manner (e.g., by disposing the above-noted box 200 within the container 100; by disposing individual transdermal patches TP, each of which may be in individual primary packaging, within the container 100). Individual transdermal patches TP may be removed from the container 100, and thereafter may be disposed of in any appropriate manner (e.g., positioned back within the container 100, for instance within the second compartment 228 of the box 200, and where the box 200 would be removed from the container 100 after the patient has used the entire prescription and where the box 200 may then be properly disposed of). A new prescription of transdermal patches can then be loaded into the container 100 in the above-noted manner.

Figure 3:
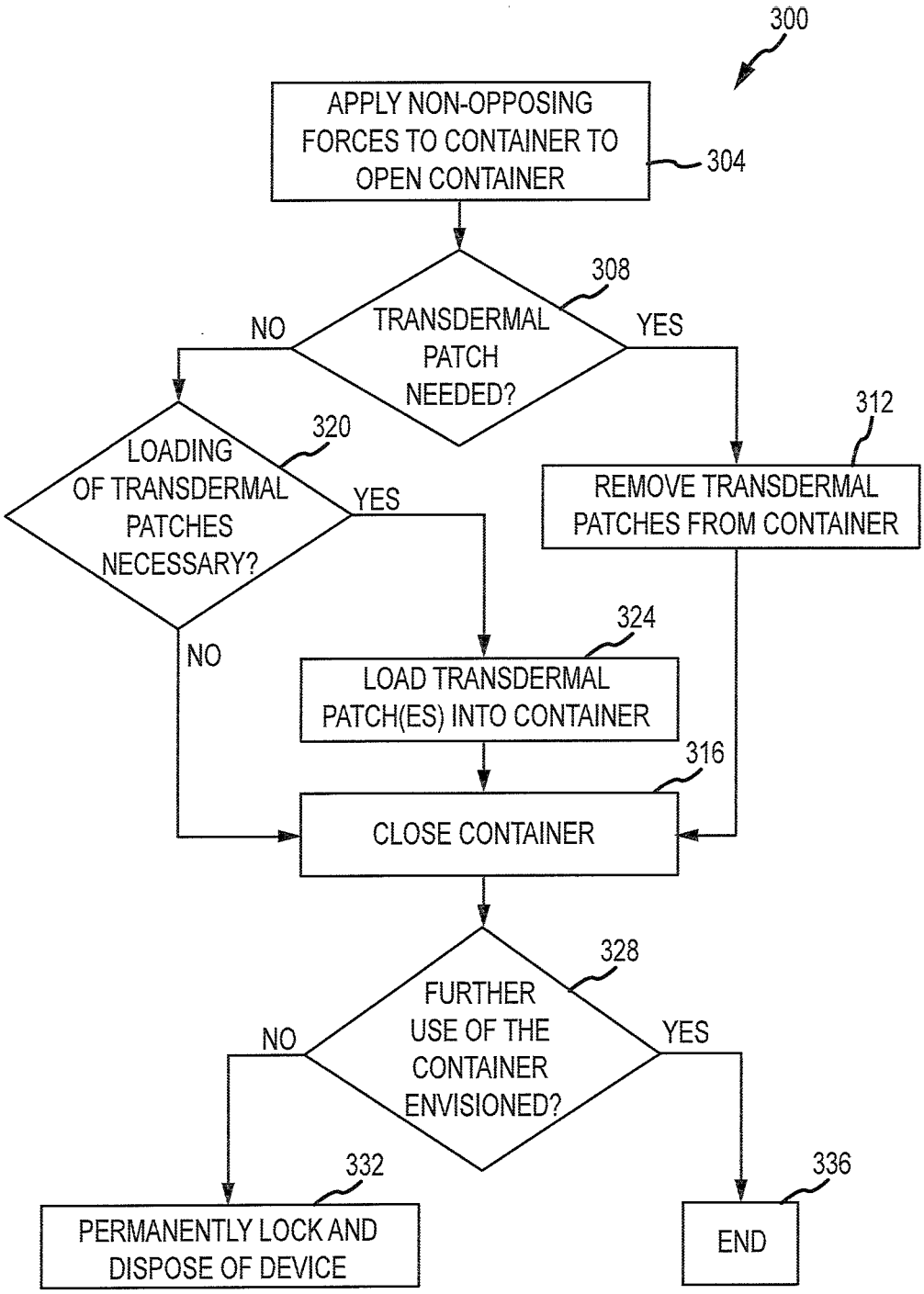
FIG. 3 is a flow diagram of a method of using the pharmaceutical product container of FIGS. 1*a*-1*c*.

Turning now to FIG. 3, one method 300 of using the container 100 is illustrated, although it will be appreciated that other methods of using the container 100 are contemplated. In step 304, non-opposing or non-collinear forces may be applied to the container (e.g., via engaging first and second non-opposing access components/buttons) to open the container and allow access to the compartment. As discussed above, engagement of the access components may be performed simultaneously, in series, etc. Thereafter, if it is decided in step 308 that pharmaceutical product such as, for example, transdermal patches is desired, one or more transdermal patches may be removed from the container in step 312 and then the container may be closed in step 316. If pharmaceutical product is not needed but it is decided in step 320 that loading of pharmaceutical product such as transdermal patches is desired, then transdermal patches may be loaded into the container in step 324 and then the container may be closed in step 316.

It should be appreciated that the loading of pharmaceutical product such as one or more transdermal patches into the container pursuant to step 320 may entail the one or more transdermal patches being in any appropriate state or condition. For instance, a carton or box (e.g., secondary packaging) may be loaded into the container pursuant to step 320, where this carton includes one or more transdermal patches individually contained within primary packaging. One or more transdermal patches, each of which is individually contained within primary packaging (e.g., a sealed pouch, jacket, or the like), may be loaded into the container pursuant to step 320. One or more transdermal patches, each of which has been removed from its primary packaging, may be loaded into the container pursuant to step 320.

If further use of the container is not envisioned in step 328, then the container may be at least substantially permanently locked (e.g., removing tear-away button; heating the container to a temperature that thereafter disables the ability of one or more access components to unlock the container) and disposed of in step 332. However, the container may be re-used any appropriate number of times in the method 300 of FIG. 3, in which case step 332 would not be executed. The method 300 may end at step 336, and at some point in time may return to step 304 at a later time for repetition in accordance with the foregoing.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A method of managing use of pharmaceutical product, comprising the steps of:

activating each of first and second access components of a pharmaceutical product container when said pharmaceutical product container is in a closed configuration, wherein said first and second access components are disposed in non-opposing relation to one another, and wherein said pharmaceutical product container is locked whenever said pharmaceutical product container is in said closed configuration;

unlocking said pharmaceutical product container using said activating in relation to each of said first and second access components;

changing said pharmaceutical product container into an open configuration after said unlocking;

changing said pharmaceutical product container from said open configuration back to said closed configuration where said pharmaceutical product container is locked; and disabling said first access component, after said pharmaceutical product container has been changed from said open configuration back to said closed configuration where said pharmaceutical product container is locked, such that said first access component is thereafter unavailable for any subsequent execution of said unlocking and such that said pharmaceutical product container is then maintained in said closed configuration where said pharmaceutical product container is locked.

2. The method of claim 1, wherein said activating comprises:

exerting a first force on said first access component of said pharmaceutical product container, wherein said first force is along a first vector; and exerting a second force on said second access component of said pharmaceutical product container, wherein said second force is along a second vector, and wherein said first and second vectors are non-collinear.

3. The method of claim 2, wherein said pharmaceutical product container further comprises a third access component, wherein said method further comprises:

activating said third access component when said pharmaceutical product container is in said closed configuration where said pharmaceutical product container is locked, wherein said activating in relation to said third access component comprises exerting a third force on said pharmaceutical product container, wherein said third force is along a third vector, and wherein said unlocking also uses said activating in relation to said third access component.

4. The method of claim 3, wherein said third vector is non-collinear relative to one of said first and second vectors.

5. The method of claim 3, wherein said third vector is non-collinear relative to each of said first and second vectors.

6. The method of claim 1, further comprising at least one of:

removing pharmaceutical product from said pharmaceutical product container when in said open configuration; and loading pharmaceutical product into said pharmaceutical product container when in said open configuration.

7. The method of claim 6, wherein at least some of said pharmaceutical product is contained within primary packaging.

8. The method of claim 7, wherein all of said pharmaceutical product is contained within secondary packaging, which in turn is disposable in said pharmaceutical product container, and wherein said pharmaceutical product that is within said primary packaging is further disposed within said secondary packaging.

9. The method of claim 6, wherein at least some of said pharmaceutical product is in a sealed configuration when disposed within said pharmaceutical product container.

10. The method of claim 6, wherein said pharmaceutical product comprises a pharmaceutical product blister pack, which in turn is disposed in said pharmaceutical product container.

11. The method of claim 1, wherein said activating in relation to said first and second access components occurs simultaneously.

12. The method of claim 1, wherein said activating in relation to said first access component and said activating in relation to said second access component are executed in series.

13. The method of claim 1, wherein said activating in relation to said first access component comprises moving said first access component along a first path, wherein said activating in relation to said second access component comprises moving said second access component along a second path, and wherein said first and second paths are other than collinear.

14. The method of claim 1, wherein said disabling comprises removing said first access component.

15. The method of claim 1, wherein said disabling comprises heating said pharmaceutical product container to a temperature such that any subsequent activation of said first access component will not be usable for any subsequent said unlocking such that said pharmaceutical product container remains locked in said closed configuration, and wherein said temperature is less than a melting temperature of a container body of said pharmaceutical product container.

16. The method of claim 1, wherein a pharmaceutical product is stored within said pharmaceutical product container and is selected from the group consisting of at least one transdermal patch, transmucosal strip or film, buccal strip or film, pharmaceutical product blister pack, or any combination thereof.

17. A method of managing use of pharmaceutical product, comprising the steps of:

activating each of first and second access components of a pharmaceutical product container when said pharmaceutical product container is in a closed configuration, wherein said first and second access components are disposed in non-opposing relation to one another, and wherein said pharmaceutical product container is locked when in said closed configuration;

unlocking said pharmaceutical product container using said activating step in relation to each of said first and second access components;

changing said pharmaceutical product container into an open configuration after said unlocking step;

changing said pharmaceutical product container into said closed configuration; and disabling said first access component such that said first access component is thereafter unavailable for any subsequent execution of said unlocking step, wherein said disabling step comprises heating said pharmaceutical product container to a temperature such that any subsequent activation of said first access component will not be usable for any subsequent said unlocking step, and wherein said temperature is less than a melting temperature of a container body of said pharmaceutical product container.

18. A method of managing use of pharmaceutical product, comprising the steps of:

activating each of first and second access components of a pharmaceutical product container when said pharmaceutical product container is locked in a closed configuration, wherein said first and second access components are disposed in non-opposing relation to one another for execution of said activating;

unlocking said pharmaceutical product container using said activating in relation to each of said first and second access components;

opening said pharmaceutical product container by changing said pharmaceutical product container from said closed configuration to an open configuration, wherein said opening is executed after said unlocking;

closing said pharmaceutical product container by changing said pharmaceutical product container from said open configuration back to said closed configuration;

locking said pharmaceutical product container after said closing to retain said pharmaceutical product container in said closed configuration; and disabling said first access component after said locking such that said first access component is thereafter unavailable for any subsequent execution of said unlocking whereby said pharmaceutical product container thereafter remains locked in said closed configuration.

* * * * *